US008057253B2

(12) United States Patent
Huang et al.

(10) Patent No.: US 8,057,253 B2
(45) Date of Patent: Nov. 15, 2011

(54) CONTACT AND CABLE ASSEMBLY WITH THE CONTACT

(75) Inventors: Chien-Hsun Huang, Tu-Cheng (TW); David Ko, Fullerton, CA (US); Hong-Wei Sun, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/814,483

(22) Filed: Jun. 13, 2010

(65) Prior Publication Data

US 2010/0317236 A1 Dec. 16, 2010

(30) Foreign Application Priority Data

Jun. 12, 2009 (CN) ..... 2009 2 0304390

(51) Int. Cl.
*H01R 3/00* (2006.01)

(52) U.S. Cl. ..... 439/499

(58) Field of Classification Search ..... 439/499, 439/497, 733.1, 744, 874
See application file for complete search history.

(56) References Cited

U.S. PATENT DOCUMENTS

| | | | | |
|---|---|---|---|---|
| 5,030,138 | A * | 7/1991 | Capp et al. | 439/497 |
| 6,129,581 | A * | 10/2000 | Lee | 439/497 |
| 6,247,978 | B1 * | 6/2001 | Wu | 439/879 |
| 6,926,562 | B1 * | 8/2005 | Wu | 439/660 |
| 2003/0129875 | A1 * | 7/2003 | Ho | 439/606 |

FOREIGN PATENT DOCUMENTS

| | | |
|---|---|---|
| TW | 302564 | 4/1997 |

* cited by examiner

*Primary Examiner* — Tulsidas C Patel
*Assistant Examiner* — Harshad Patel
(74) *Attorney, Agent, or Firm* — Wei Te Chung; Andrew C. Cheng; Ming Chieh Chang

(57) ABSTRACT

A contact used in a cable assembly for connecting to cables includes a flat portion extending along a horizontal direction, a flat connecting portion forward extending from the flat portion, a pair of fastening arms respectively extending from two sides of the flat portion along a vertical direction and a mating portion formed by two curving pieces and respectively forwardly extending from the fastening arms; wherein said cables are soldered on the contacts.

8 Claims, 4 Drawing Sheets

CONTACT AND CABLE ASSEMBLY WITH THE CONTACT

BACKGROUND OF THE INVENTION

1. Field of the Invention

The present invention relates generally to a cable assembly, and more particularly to a cable connector with special contacts.

2. Description of the Prior Art

Wire harness connector is widely used in many electrical device for its well transmitting feature. TW Patent No. 302564 discloses an electrical connector which includes a housing with a plurality of receiving holes, a plurality of contacts received in the receiving holes, and cables crimped by the contacts. The contacts are crimping contacts, thus, in assembly, the contacts are needed to be connected to the cables firstly and then be inserted into the receiving holes of the housing one by one. Thus, this type of contacts reduce producing efficiency and is not fit for roboticized production.

Hence, in this art, a contact to overcome the above-mentioned disadvantages of the prior art should be provided.

BRIEF SUMMARY OF THE INVENTION

A primary object, therefore, of the present invention is to provide a contact fit for roboticized production.

In order to implement the above object, the contact used in a cable assembly for connected to cables comprises a flat portion extending along a horizontal direction, a flat connecting portion forward extending from the flat portion, a pair of fastening arms respectively extending from two sides of the flat portion along a vertical direction and a mating portion formed by two curving pieces and respectively forwardly extending from the fastening arms; wherein said cables are soldered on the contacts.

Other objects, advantages and novel features of the invention will become more apparent from the following detailed description of a preferred embodiment when taken in conjunction with the accompanying drawings.

DETAILED DESCRIPTION OF THE INVENTION

Figure 1:
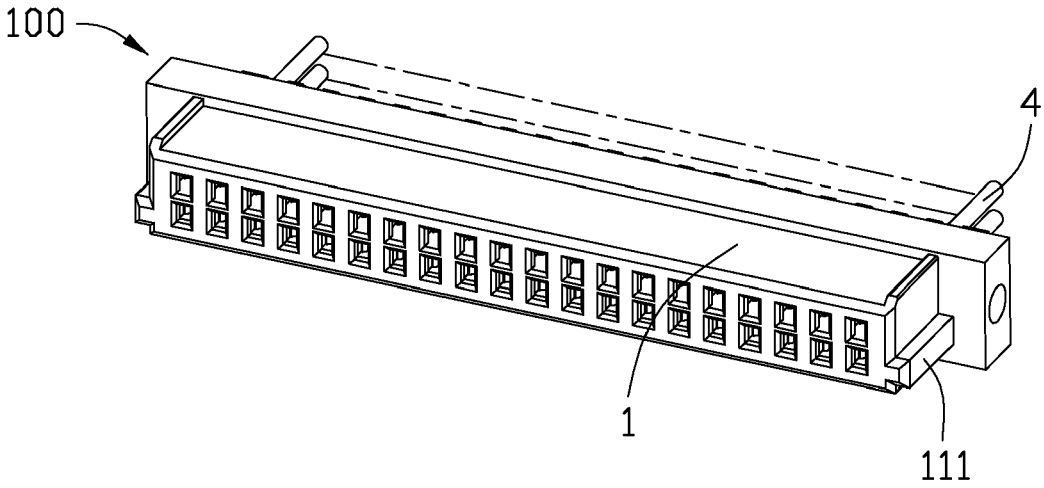
FIG. 1 is a perspective view illustrating a preferred embodiment of a cable assembly in according with the present invention.
Figure 2:
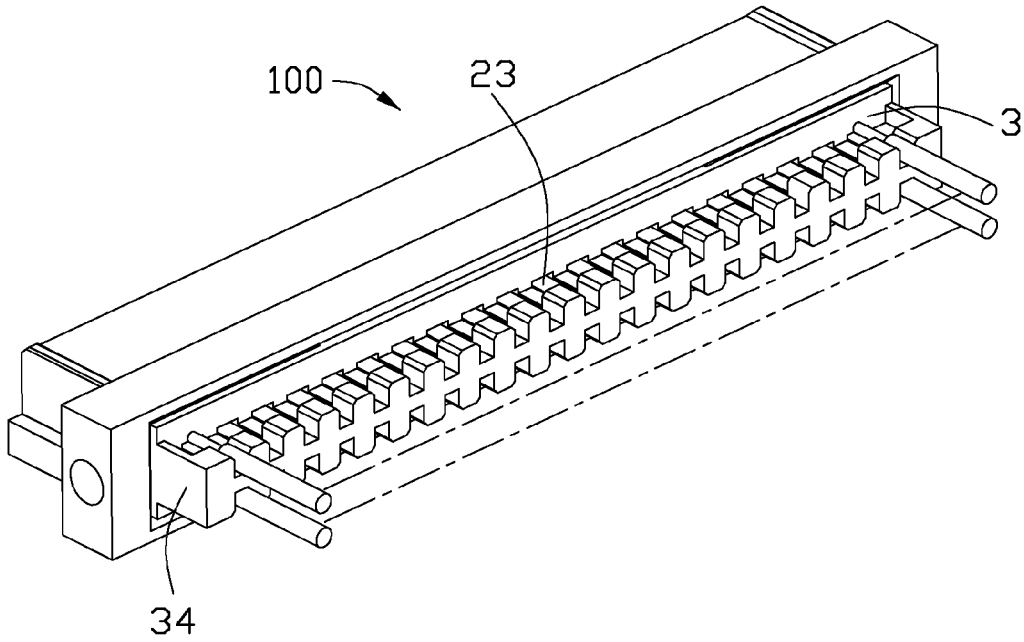
FIG. 2 is a view similar to FIG. 1, but viewed from another angle.

Reference will now be made in detail to a preferred embodiment of the present invention.

Reference to FIGS. 1 to 4, a cable assembly 100 in according with a preferred embodiment of the present invention is shown. The cable assembly 100 comprises a housing 1, a plurality of contacts 2 received in the housing 1, a cable 4 connected to the tails of the contacts 2 and a spacer 3 assembled on the rear portion of the housing 1.

The housing 1 is substantially of T-shaped configuration, and comprises a mating portion 11 and a main portion 12 located behind the mating portion 11. The mating portion 11 comprises a top wall 112, a bottom wall 113 and a pair of side walls 114, 115 connecting the top wall 112 to the bottom wall

113. The top wall 112 has a pair of guiding ribs 110 located on the two sides thereof and extending along a mating direction. Each of the side wall 114, 115 comprises a guiding column 111 located on the joint portion of the side wall and the bottom wall 113 and extending along the mating direction. The guiding ribs 110 and the guiding columns 111 are used to guide the cable assembly 100 exactly insert into a mating connector (not shown). Two rows of receiving grooves 13 are formed in the housing 1 and extend along the mating direction to pass through the mating portion 11 and the main portion 12. A receiving space 120 is formed in the rear portion of the main portion 12 and forwardly concaved from the rear surface of the main portion 12. Each of the receiving groove 13 comprises a front end on the front surface of the mating portion 11 and a rear end connected to the receiving space 120 and being larger than the front end for firmly fastening the contacts 2 in the housing 1. A pair of ribs 121 are formed on the bottom wall of the receiving space 120 for guiding the spacer 3 accurately inserting into the receiving space 120. A pair of blocking walls 122 are formed in the receiving space 120 and located on the two sides of all the receiving grooves 13. The mating portion 11 has a length longer than the length of the main portion 12 along the mating direction and the main portion 12 has a height bigger than the height of the mating portion 11 along a vertical direction perpendicular to the mating direction.

Figure 3:
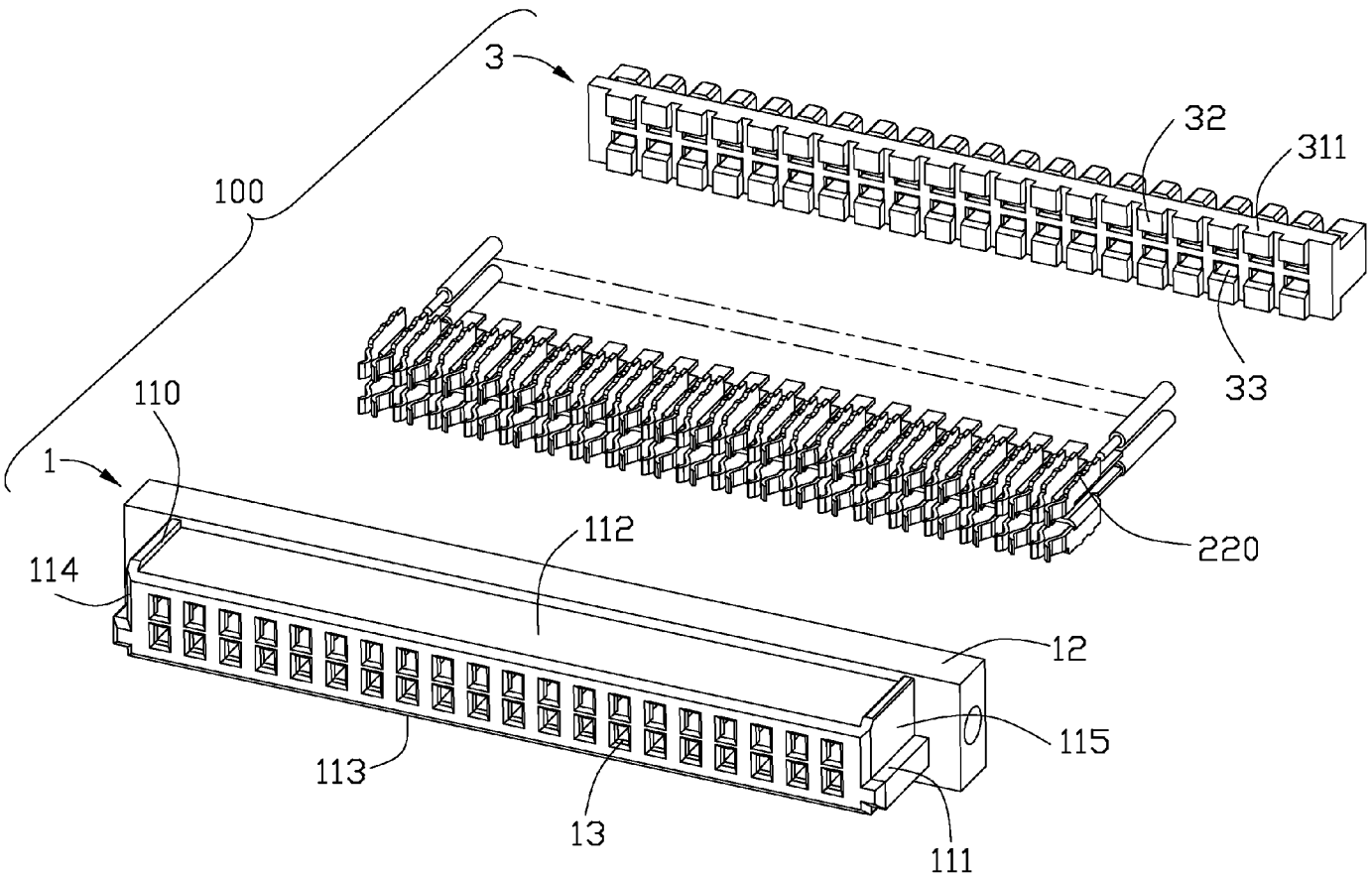
FIG. 3 is an exploded, perspective view of FIG. 1.
Figure 4:
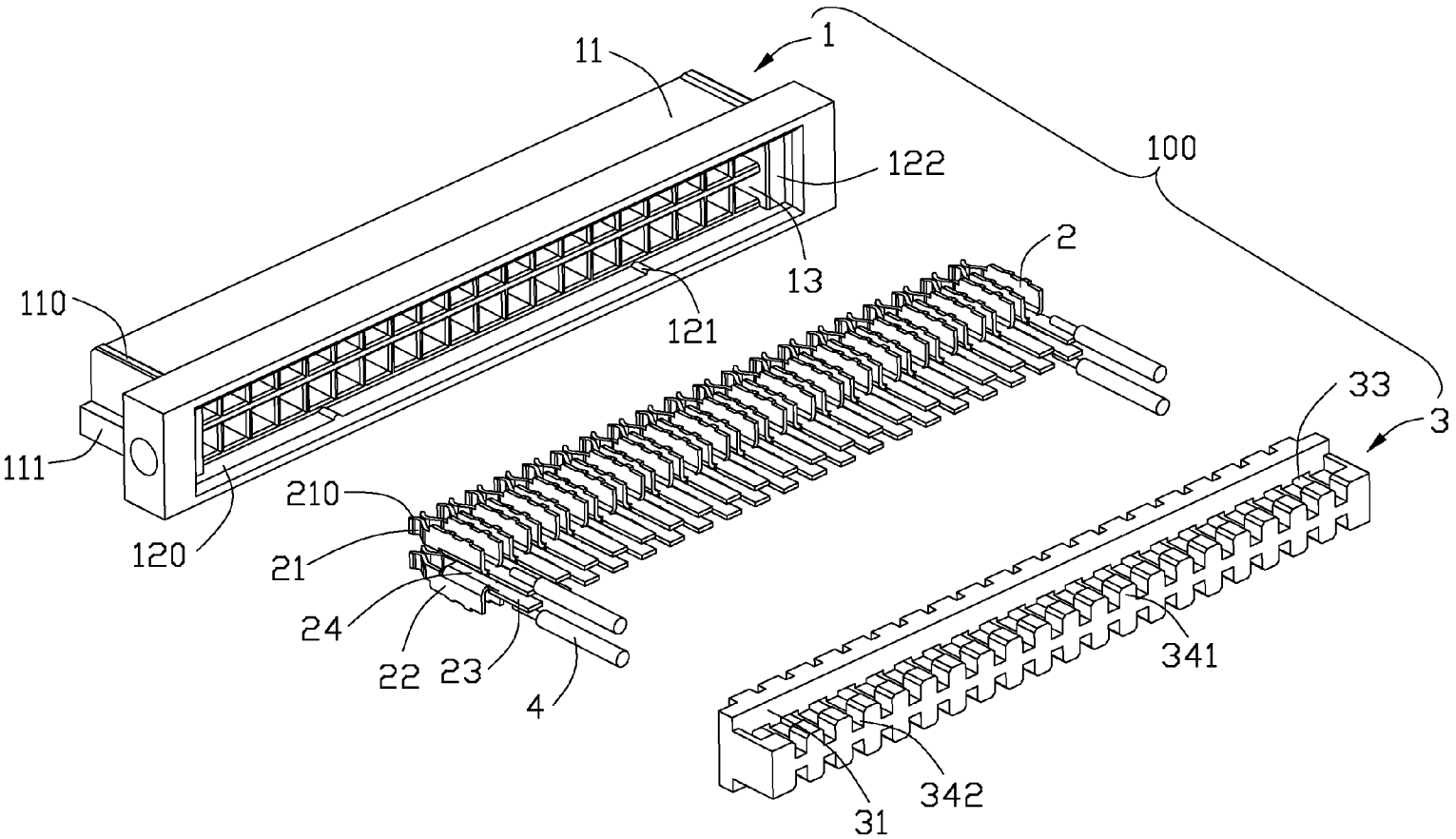
FIG. 4 is a view similar to FIG. 2, but viewed from another angle.

Reference to FIGS. 3 and 4, contacts 2 are arranged in two rows for being inserted into the two rows of receiving grooves 13. Each contact 2 comprises a flat portion 24, a pair of fastening arms 22 extending from the two sides of the flat portion 24 along the vertical direction, a mating portion 21 formed by two curving pieces 210 respectively forwardly extending from the fastening arms 22, and a connecting portion 23 rearward extending from the flat portion 24 for connecting the cable 4. Each of the fastening arm 22 comprises a pair of stabs 220 on the top thereof for matching to an upper inner wall of the receiving grooves 13. Reference to FIG. 3, the flat portion 24 and the two fastening arms 22 substantially form a U shape. Every two curving pieces 210 of the mating portion 21 substantially form an X shape. The mating portion 21 is separated from the flat portion 24 for strengthening the flexibility of the mating portion 21 so as to connect the mating connector firmly. The connecting portion 23 is substantially as wide as the width of the flat portion 24. The contact 2 is substantially forcipate, and the flat portion 24 and the connecting portion 23 are arranged on the same plane for firmly fastened in the receiving groove 13.

The spacer 3 comprises a lengthwise main body 31 with a top surface 311, a plurality of protrusions 32 forward extending from the front surface of the main body 31, and a supporting portion 34 rearward extending from the rear surface of the main body 31. The protrusions 32 are arranged in two rows and corresponding to the receiving grooves 13. The supporting portion 34 comprises a plurality of receiving troughs 342 corresponding to the receiving grooves 13 and forward extending trough the main body 31 to form a plurality slots 33 arranged between the two rows of the protrusions 32. A plurality of stages 341 are arranged on the rear portion of the supporting portion 34 and every two stages 341 are respectively located on two sides of each receiving trough 342. The stages 341 are separated from the main body 31 for the cable can be soldered on the contacts by motor welding equipment (not shown). The rear view of the supporting portion 34 can be regarded as one row of crosses, and the number of the crosses is 19.

In assembly, firstly contacts 2 are assembled into the receiving grooves 13 of the housing 1. Secondly, the front portion of the spacer 3 is assembled in the receiving space 120 of the housing 1 and the protrusions 32 attach and cover the rear end of the receiving grooves 13. The front surface of the main body 31 of the spacer attaches to the rear surface of the blocking wall 122, at the same time, the connecting portions 23 of the contacts 2 pass through the slots 33 of the spacer 3 and received in the receiving troughs 342. Thirdly, the cables 4 are respectively received in the receiving troughs 342 with the inner conductors connected to the contacts 2 and the outer cover clipped between the corresponding stages 341. Fourthly, the cables 4 are respectively soldered on the corresponding contacts 2 by the melting equipment. Lastly, the housing 1, the contacts 2, the spacer 3 and the cable 4 are over molded to form a cable assembly. At the same time, the protrusion 32 can prevent insulative plastic flowing into the receiving grooves 13.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A cable assembly, comprising:

a housing having a plurality of receiving grooves;

a plurality of contacts received in the receiving grooves, and each being substantially forcipate, and comprising a flat portion received in the receiving groove, a connecting portion rearward extending from the flat portion, a pair of fastening arms extending from two sides of the flat portion along a vertical direction and a mating portion formed by two curving pieces and respectively forwardly extending from the fastening arms;

a plurality of cables corresponding to the contacts, and respectively electrically connected to the corresponding contacts; and a spacer assembled on the rear portion of the housing, and comprising a main body with a plurality of slots and a supporting portion rearward extending from the rear surface of the main body; wherein said supporting portion comprises a plurality of receiving troughs and a plurality of stages, every two stages are respectively located on two sides of each receiving trough, the connecting portions of the contacts are respectively received in the receiving trough and located between the stages and the main body of the spacer, and said cables are clipped between the stages and comprise inner conductors respectively connected to the connecting portions of the contacts, every two curving pieces of the mating portion substantially form an X shape, and the mating portion are separated from the flat portion, said spacer comprises a plurality of protrusions forward extending from the front surface of the main body, and the protrusions respectively attach and cover the rear ends of the receiving grooves.

2. The cable assembly as claimed in claim 1, wherein the flat portion and the connecting portion are arranged on the same plane for firmly fastened in the receiving groove.

3. The cable assembly as claimed in claim 2, wherein said mating portion extends along a mating direction which is perpendicular to the vertical direction the fastening arms extending along.

4. The cable assembly as claimed in claim 1, wherein said protrusions are arranged to form two rows and said slots are located between the two rows of the protrusions.

5. The cable assembly as claimed in claim 1, wherein said contacts are arranged in two rows and the two rows of the contacts are symmetrical.

6. An electrical connector comprising:

an insulative housing defining a plurality of passageways extending along a front-to-back direction;

a plurality of contacts disposed in the corresponding passageways, respectively, each of said contacts defining a middle U-shaped retention section located between a pair of front deflectable contacting arms and a rear tail;

an insulative spacer including a vertical main body with opposite inner and outer surfaces thereon, a plurality of protrusions formed on said inner surface and respectively inserted into rear openings of the corresponding passageways, a supporting portion extending rearwardly from the outer surface with a plurality of slots in alignment with the corresponding passageways, respectively, in said front-to-back direction; wherein the protrusions abut against the U-shaped retention sections of the corresponding contacts, respectively, and the tails extend through the main body and enter the corresponding slots, respectively.

7. The electrical connector as claimed in claim 6, wherein said housing defines a recess in a rear face to receive the main body therein.

8. The electrical connector as claimed in claim 6, wherein the spacer is further equipped with a plurality of troughs behind the corresponding slots, respectively, each of said troughs being confined between two neighboring stages, and a plurality of cables being received in the corresponding troughs with corresponding inner conductors soldered to the corresponding tails, respectively.

* * * * *